US005078206A

United States Patent [19]

Goetz, Jr.

[11] Patent Number: 5,078,206

[45] Date of Patent: Jan. 7, 1992

[54] TUBE AND FIN CIRCULAR HEAT EXCHANGER

[76] Inventor: Edward E. Goetz, Jr., 4611 Webberdale, Holly, Mich. 48442

[21] Appl. No.: 537,497

[22] Filed: Jun. 12, 1990

[51] Int. Cl.[5] ..... F28D 1/04; F28F 13/12; F28F 9/26; F01P 7/10

[52] U.S. Cl. ..... 165/125; 165/41; 165/44; 165/51; 165/150; 165/152; 165/153; 165/140; 123/41.49

[58] Field of Search ..... 165/41, 44, 125, 148, 165/152, 153, 150, 140; 123/41.49

[56] References Cited

U.S. PATENT DOCUMENTS

| | | | |
|---|---|---|---|
| 1,365,759 | 1/1921 | Witte | 165/153 |
| 2,029,891 | 2/1936 | Newman . | |
| 2,429,508 | 10/1947 | Belaieff | 165/125 |
| 2,646,027 | 7/1953 | Akerman et al. . | |
| 2,650,073 | 8/1953 | Holm | 165/152 |
| 2,792,200 | 5/1957 | Huggins et al. | 165/125 |
| 4,062,401 | 12/1977 | Rudny et al. | 165/125 |
| 4,202,296 | 5/1980 | Nonnenmann et al. . | |
| 4,373,577 | 2/1983 | McMillen | 165/148 |
| 4,434,841 | 3/1984 | Jackson et al. . | |
| 4,510,991 | 4/1985 | Kawahira . | |
| 4,909,311 | 3/1990 | Nakamura et al. | 165/41 |

FOREIGN PATENT DOCUMENTS

| | | | |
|---|---|---|---|
| 0036213 | 9/1981 | European Pat. Off. | 165/125 |
| 0193088 | 11/1983 | Japan | 165/125 |
| 582245 | 11/1946 | United Kingdom | 165/152 |

*Primary Examiner*—John Ford
*Attorney, Agent, or Firm*—Charles R. White

[57] ABSTRACT

A heat exchanger is disclosed comprising a pair of laterally spaced fluid conducting tanks operatively interconnected by a plurality of elongated fluid conducting tubes having sector shaped cross sections and arcuately spaced from one another in a circular pattern to present parallel interfacing sides. A plurality of elongated corrugated fins or air centers each having convolutions of substantially constant height and width to have spaced lines of contact along the width and length of each of the sides of the tubes for maximizing heat transfer and so that the tubes will be optimally supported to provide increased resistance to pressure ballooning and burst. These air centers are standard corrugated rectilinear components that reduce complexity and cost of this circular heat exchanger. This heat exchanger can be arranged in a parallel relationship with a transverse automotive engine and a cooling fan operatively mounted within the heat exchanger can be directly driven by the engine. An annular oil cooler and air conditioner condenser can also surround the heat exchanger.

10 Claims, 4 Drawing Sheets

FIG 9
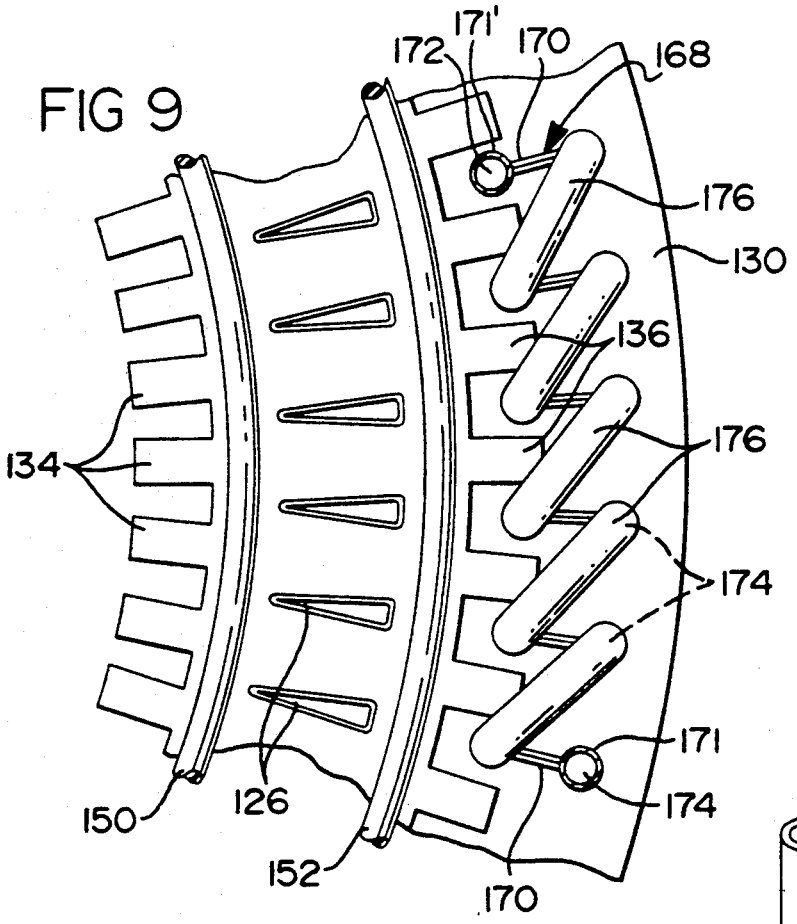
FIG 9a
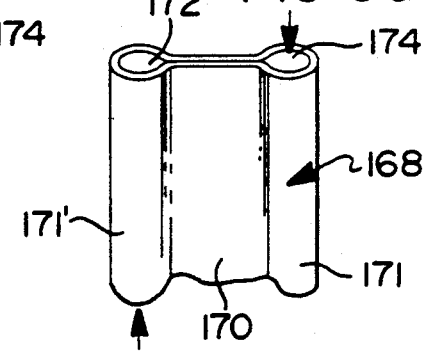
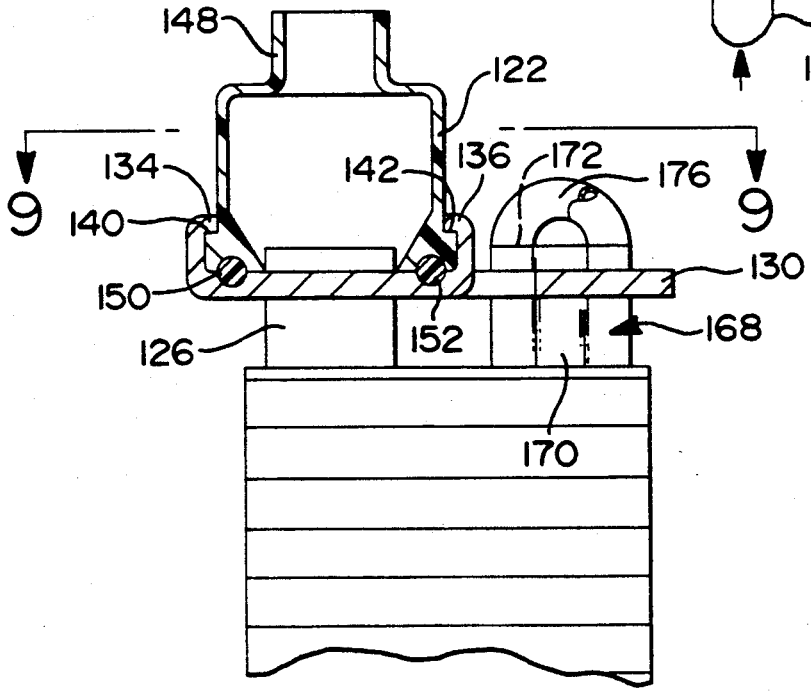
FIG 8

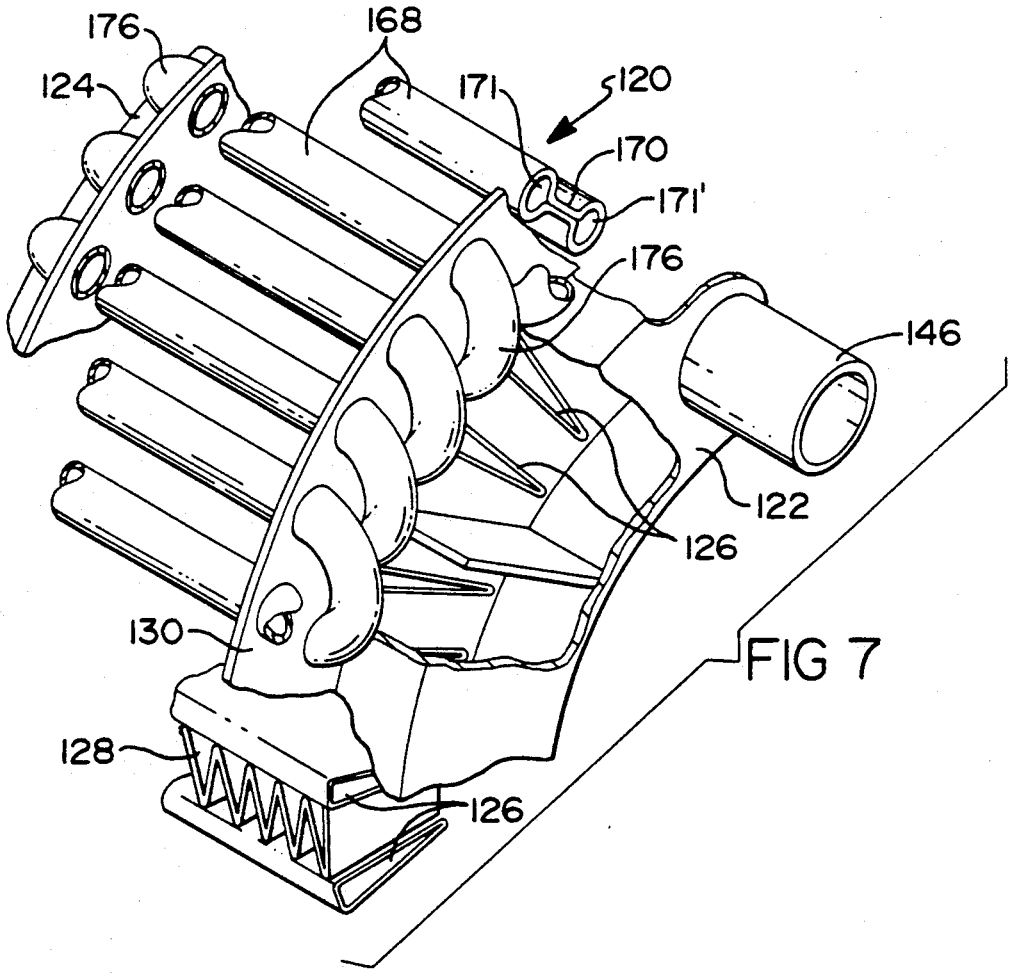
FIG 7
FIG 10
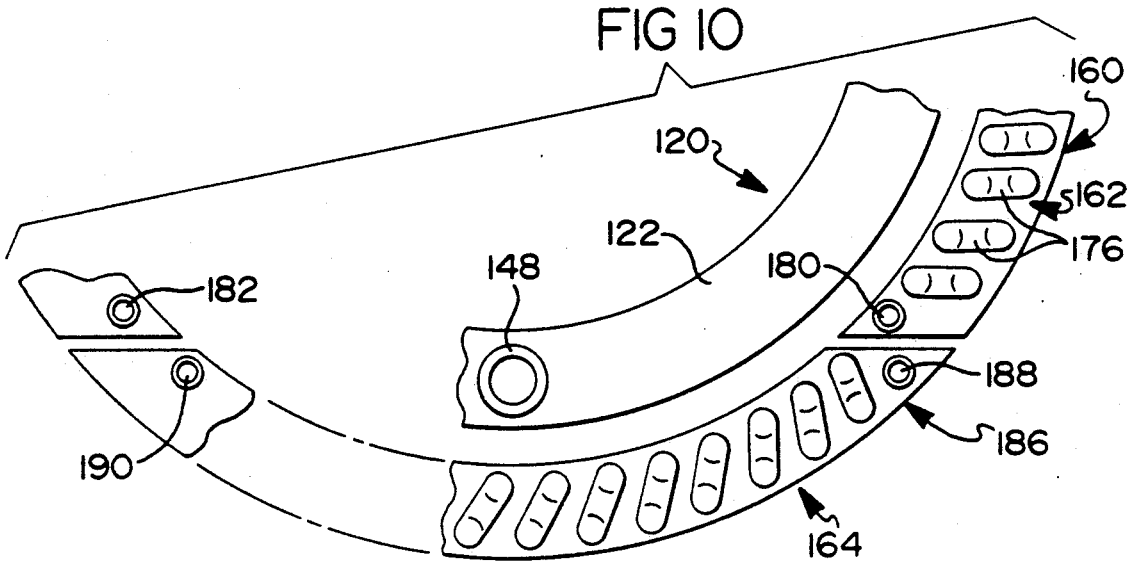

TUBE AND FIN CIRCULAR HEAT EXCHANGER

TECHNICAL FIELD

This invention relates to heat exchangers and more particularly to a new and improved core configuration which employs standard fins or air centers formed of corrugated rectilinear thin wall strips of thermally conducting metal operatively interposed between adjacent sides of heat exchanger tubes of sector shaped cross sections arranged in passes defining a circular pattern and providing improved core heat conductivity and burst strength.

BACKGROUND OF THE INVENTION

Circular heat exchangers have been employed in a wide range of applications such as for condensers for refrigerators and air conditioners as well as for radiators for cooling internal engines and power transmission. Examples of such constructions are disclosed in U.S. Pat. Nos. 2,029,891 (Condenser For Refrigerator), 4,062,401 (Radiator For Engine Transmission And Hydraulic Accessories), 4,202,296 and 4,510,991 (Radiator For Cooling Internal Combustion Engines). Such heat exchangers are, in general, complex and costly and their use is restricted since they require numerous special components and in particular many require specialized corrugated fins or air centers used to support the heat exchanger tubes and to effectively increase the external surface area for enhancing heat transfer. Generally these centers are made from corrugated strips of the heat conducting metal which are brazed or otherwise secured at their apecies or peaks to adjacent sides of any two tubes. In the event that the tubes are arcuately spaced and have a rectilinear form, the air centers need to be tapered or otherwise formed to provide the necessary contact along the width and length of adjacent tubes for optimizing heat conducting therefor efficiency. Such air centers are not market available and are difficult to manufacture particularly as compared to conventional rectilinear corrugated air centers which have constant convolution height and width throughout their lengths.

SUMMARY OF THE INVENTION

The present invention provides a heat exchanger with a curved arrangement of fluid passage tubes with sector shape cross sections which terminate in curved frontal edges and of minimized widths. These tubes extending between header tanks are arcuately spaced on radii originating from a center line and which present parallel, spaced and flattened sides that receive standardized air center to improve heat exchanger burst strength while providing high surface contact for optimizing heat transfer.

The present invention also provides a new and improved heat exchanger with flow passage tubes sector shaped in cross section arranged in a circular pattern with the ends thereof in operative communication with a flow tank and in which air centers formed from corrugated rectilinear stock of heat conductive heat material with substantially uniform widths for uniform spaced line contact with adjacent and substantially parallel sides of the tubes.

The present invention also provides new and improved flow tubes for a heat exchanger each having a cross section in the general shape of a sector of a circle with curved apecies of minimal width so that when tubes are arcuately spaced the side walls of adjacent tubes are substantially parallel and provide substantially equal and constant spaces therebetween. With this standardized air centers construction generally rectilinear in plan view, can be employed therewith in a curved heat exchanger design for minimizing resisting to air flow through past the tubes. The cross section of the tubes is preferably enlarged to increase flow capacity and thereby reduce fluid velocity to increase transit time for increased heat transfer to the cross flow of ambient air passing around the air centers.

The present invention additionally can be employed as an engine cooling radiator arrangement for automobiles which can be used with a transverse engine and engine driven fan internal of the radiator for optimized streamlining of the vehicle with low hood lines and preferably with air intake beneath the vehicle such as below the front bumper.

It is a feature object and advantage of this invention to provide a new and improved heat exchanger with discrete and independent sections to function with heat handling mechanisms.

These and other feature objects and advantages of the present invention will become more apparent from the following Detailed Description and Drawing in which:

DESCRIPTION OF THE DRAWINGS

FIG. 7 is a pictorial view of a portion of a heat exchanger illustrating another embodiment of this invention.

FIG. 8 is a view partly in cross section taken generally along lines 8—8 of FIG. 7.

FIG. 9 is an end view taken generally along the sight lines 9—9 of FIG. 8 with the annular tank removed and with tank retainer tabs in radial position prior to installation of the tank.

FIG. 9*a* is a pictorial view of an end portion of one of the outer tubes of the second embodiment.

FIG. 10 is a end view of the heat exchanger of FIGS. 7-9 with some components tubing removed.

Figure 1:
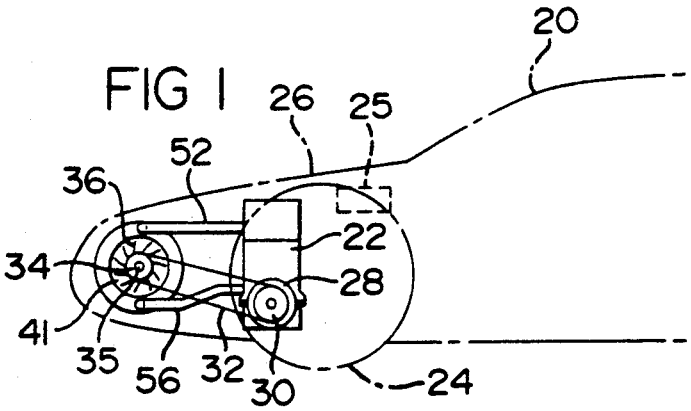
FIG. 1 is a side elevational view of a portion of a motor vehicle having a transverse internal combustion engine and associated engine cooling fan and heat exchanger assembly arranged according to the principles of this invention.

Turning now in greater detail to the Drawing, there is shown in FIG. 1 a portion of an automotive vehicle 20 having an internal combustion engine 22 transversely mounted within the front engine compartment of the vehicle which through a conventional hydrodynamic charge speed transmission drives the front wheels one of which is identified by numeral 24. This vehicle may have an air conditioner system having an evaporator 25 located in a module within the engine compartment and a condenser later described. A hood 26 having a low and aerodynamically streamlined profile for the vehicle provides a closure for the engine compartment. The engine crank has a conventional viscous clutch 28 mounted on the end thereof which operates to transmit torque when the temperature of the engine coolant exceeds a predetermined temperature to drive a pulley 30 mounted on the output side of the clutch. Pulley 30 drives an endless belt 32 that extends around and drives a fan drive pulley 34 operatively mounted on the drive shaft 35 of a transverse multi bladed fan 36 of a transverse fan and heater exchanger assembly. This assembly is operatively mounted by suitable bracketry partially shown at 38 in FIG. 2 within the engine compartment of the vehicle forwardly of and generally parallel to the transverse engine 22.

The transverse fan can be a cage type fan or a fan of any suitable configuration which can be operatively mounted within the confines of an encompassing cylindrical radiator assembly 40 that is secured by the bracketry 38 to support structure within the engine compartment. Preferably the fan, when rotatably driven by the engine, can pump air routed from an intake 41 in a lower portion of the vehicle below the front bumper line to the center of the radiator outward through the air centers and past especially shaped fluid conducting tubes to provide improved air flow and a high heat transfer coefficient.

The cylindrical radiator has in the preferred embodiment of the invention cylindrical header tanks 44, 46 defining the opposite ends of the radiator assembly which are made of a suitable material such as aluminum or copper or even of a suitable plastic material. The end tanks 44, 46 are generally toroidal in shape but have rectilinear cross-sectional configurations defined by circular inner and outer end walls connected by inner and outer radial walls connected together to provide passages for cooling fluids circulating therein. These passages are appropriately partitioned so that a serpentine fluid flow path is provided by the radiator assembly leading from cylindrical inlet spout 50 connected to the liquid coolant outlet of the engine by hose 52 to cylindrical outlet spout 54 connected to the coolant intake of the engine via hose 56.

Figure 2:
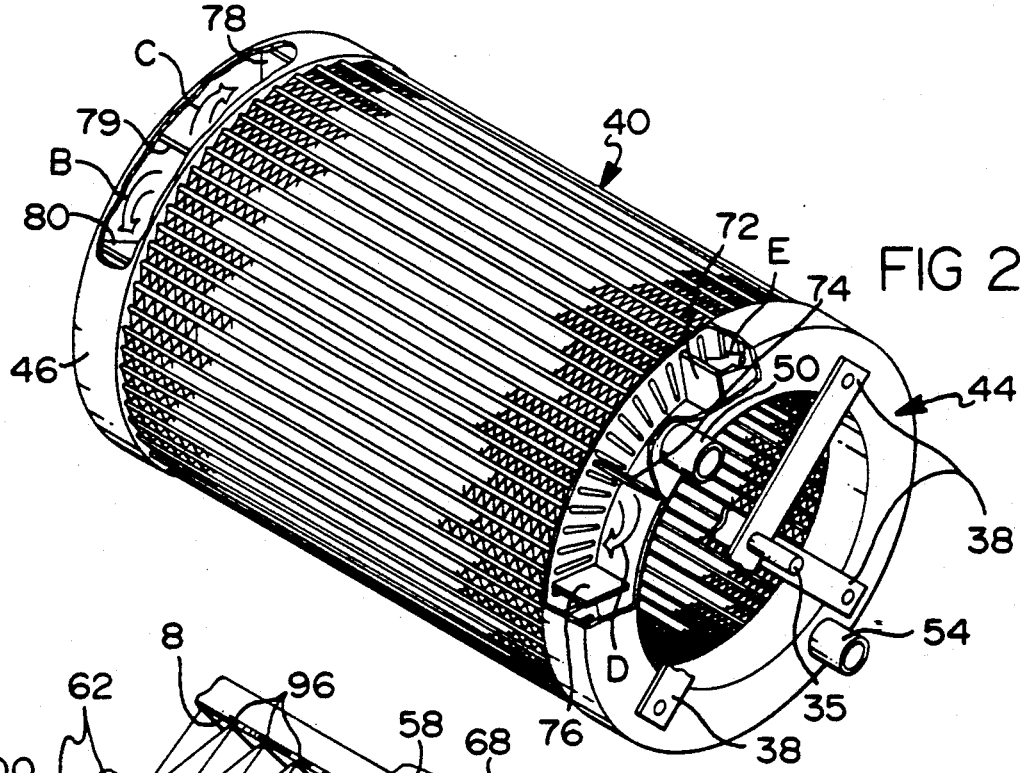
FIG. 2 is a pictorial view of the heat exchanger use in the vehicle of FIG. 1.
Figure 3:
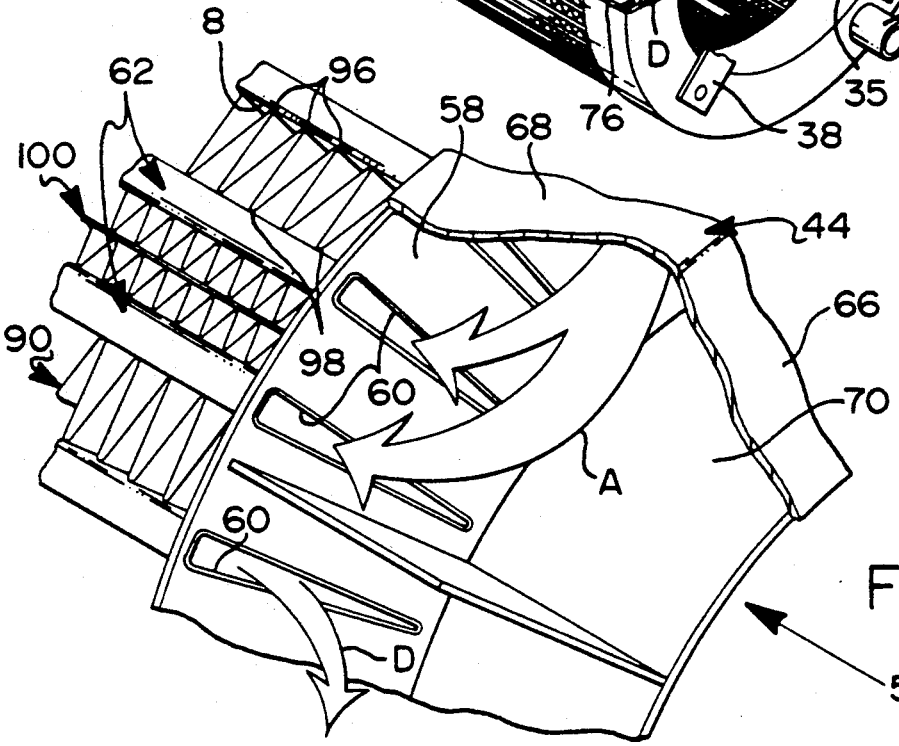
FIG. 3 is an enlarqed view of a portion of the heat exchanger of FIG. 2 illustrating the curved arrangement of the tubes and the air centers.

The inlet and outlet spouts are only provided for tank 44 and while the construction of both tanks is otherwise similar, tank 44 is the better illustrated. As shown in FIGS. 2 and 3, tank 44 has an inner end wall 58 formed with an annular arrangement of radial slots 60 which are pie shaped sectors of a circle that extend therethrough to accommodate the ends of corresponding sector shaped fluid conducting tubes 62 which are entirely separate from one another. The opposite sector shaped ends of these tubes extend through corresponding sector shaped openings formed in the end wall of the opposing header tank 46.

In addition to the inner end wall, the tank 44 has an outer end wall 66 has annular openings that accommodate the diametrically opposed fluid inlet and outlet spouts 50, 54 brazed or otherwise welded thereto. With the tank 44 having inner and outer circumferential walls 68 and 70 connecting walls 58 and 66, an annular fluid chamber is formed by tank 44. This annular chamber is however blocked at preselected and strategic locations by the radial partitions 72, 74, 76 and others not shown in the tank 44. The corresponding chamber in tank 46 is blocked by strategically located partitions such as partitions 78, 79, 80, others not shown, to force the engine coolant to flow in a serpentine path through the passes formed by predetermined tubes 62 in the heat exchanger.

Figure 4:
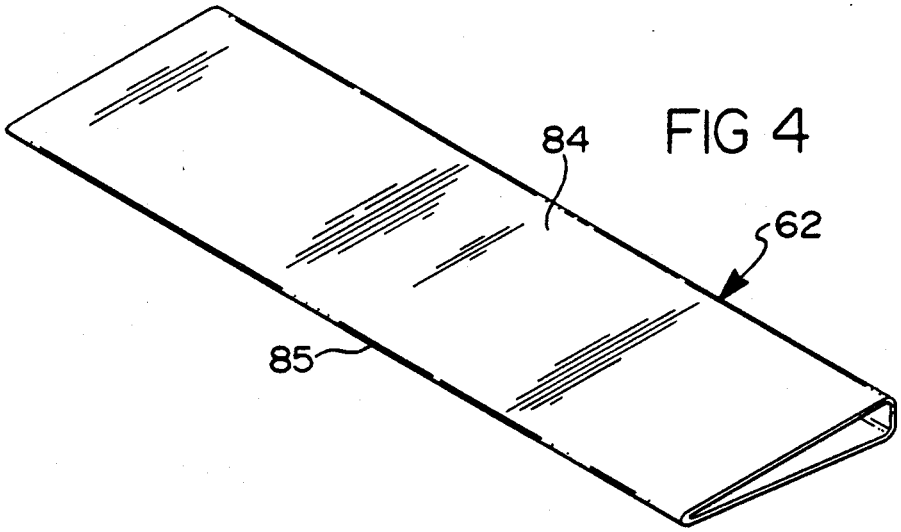
FIG. 4 is a pictorial view of one of the tubes of the heat exchanger of FIGS. 1-3.

FIG. 4 shows a preferred embodiment of one of the fluid passage tubes 62 which is an elongated hollow wedge or triangular shaped member of continuous material that has opposing wide sides 82, 84 which taper inwardly from a wide outboard edge to a terminus interior or apex edge 85 which is rounded and has a low frontal area.

Figure 5:
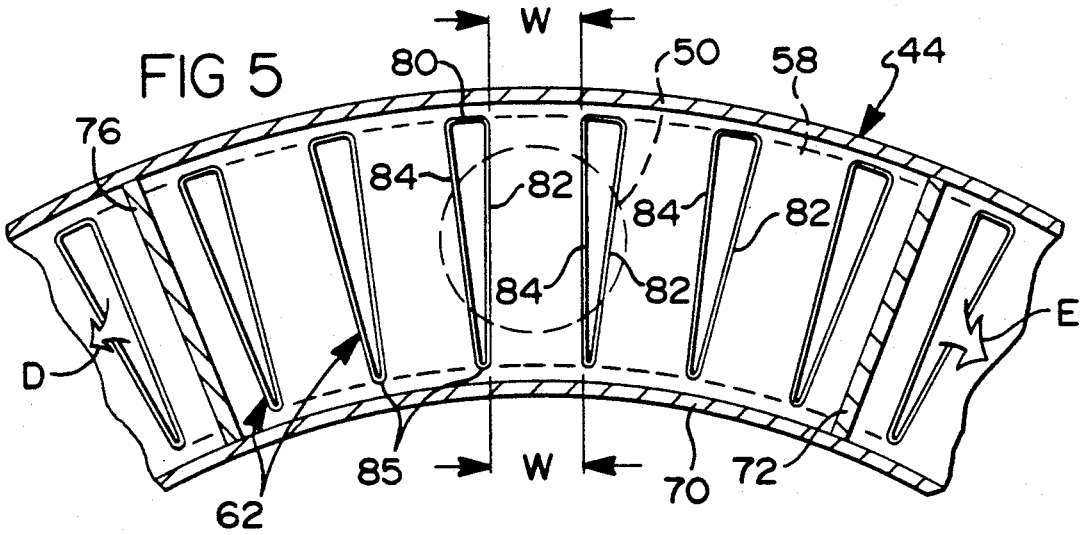
FIG. 5 is an end view of a portion of the heat exchanger as generally viewed in the direction of sight arrow 5 in FIG. 3.
Figure 6A:
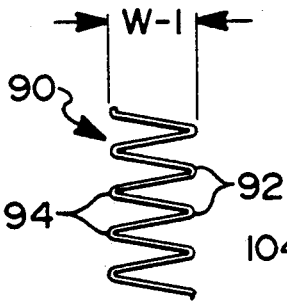
FIG. 6*a* and 6*b* are pictorial views of standardized corrugated metal air centers usable in the heat exchanger of this invention.
Figure 6B:
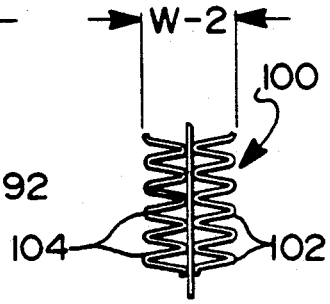

As shown best in FIG. 5, the side portions 82, 84 of any adjacent two of the tubes as supported by the header tanks 44 and 46 have a constant and fixed spaced or width W throughout their lengths which receives the standard corrugated fins or air centers shown in two forms in FIGS. 6*a* and 6*b*.

In FIG. 6*a* an air center 90 is formed from a rectilinear ribbon of thin walled material such as aluminum having a rate of heat conductivity which is corrugated to have a series of alternating side convolutions 92, 94 with apices that have lines of contact such as at 96. 98 (FIG. 3) with interfacing sides 82, 84 of adjacent tubes 62 substantially throughout their length and width. Since this air center 90 is fabricated from rectilinear sheet metal stock of constant width and length, the width W1 can be selected to appropriately fit in the space W between defined between the side walls 82, 84 of adjacent fluid conducting tubes and brazed or otherwise secured in place.

The sandwiched type air centers 100 of FIG. 6*b* is a commercially available fin construction which can be readily fitted in the spaces W if desired. These air centers have an intermediate divider plate 102 sandwiched and brazed between adjacent corrugated strips 102, 104 to have a width W-2 equal to width W-1 of air center 90. With either type, the width of the air center is substantially equal to or just slightly less than the width between adjacent tubes 62 of the passes so that they can be readily inserted into the spaces W and brazed or otherwise secured in place without any substantial modification. With the air centers secured in place there is optimized heat transfer especially when the fan is driven to pump cooling air through the centers and with circular support of the tubes for optimizing burst strength with full line contact at predetermined points along the sides of each of the tubes.

Figure 5A:
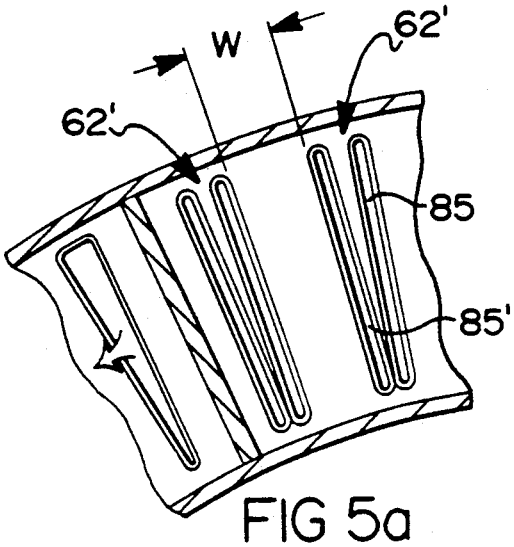
FIG. 5*a* is an end view similar to FIG. 5 showing a modification of flow tube passages that can be used in this invention.

In the modification of FIG. 5*a*, each tube or pass 62' is formed from separate and discrete flat tubes 85, 85' of the same configuration which are disposed in a v-shape relationship, as shown, so as to provide a width W' therebetween which is constant to match width W of FIG. 5. With this width the standard width air centers of FIGS. 6*a* and 6*b* can be fitted therebetween.

It will be appreciated that the enlarged cross sectional portion of the tubes provide increased flow capacity of the heated coolant flowing therethrough. This effectively reduces flow velocity through the tubes so that the transit time is reduced for flow between the tanks. This provides for increased amounts of heat energy being dissipated from the coolant to ambient air as the coolant flows at a reduced rate through the passes provided by the tubes.

In operation with the transverse fan being driven by the engine and with the engine coolant thermostats open, the coolant will be transmitted through hose 50 and to the radiator inlets spout 50 and into the header tank 44. The first pass flow, flow arrow A will be divided and substantially equal flow volumes down the first six tubes 84 bounded as determined by the arcuately spaced partitions 72 and 76 in the header tank 44. This pass flow, arrow A, will be split by partition 79 in header tank 46 and routed by the arcuately spaced partition 78 and 80 on either side of the partition 79 into separate passes comprising three adjacent tubes counting clockwise and counter clockwise from the outside tubes of the first pass and as indicated by flow arrows B and C. With other partitions strategically placed in the header tanks 44 and 46, the flow will be equally divided in the first pass and split into serpentine clock wise and counter clockwise flow paths as indicated by the arrows A, B and E, C and D until they recombine at a final pass or exit at spout 54 for returning the engine via hose 56. By this means there is optimized serpentine flow of engine coolant through all of the tubes and optimized transfer of heat energy from the high temperature coolant through the wide and flat side walls of the tubes and the associated air centers into the ambient air forced through the core by fan 36. With the flow through the high capacity tubes reduced in velocity, pass time is increased for optimized heat transfer efficiency during this operation.

Turning now to FIGS. 7 through 10, a second embodiment of the heat exchanger identified by numeral 120 is disclosed. As in the first embodiment, the heat exchanger 120 is a cylindrical unit having end tanks 122 and 124 which are connected by inner tubes 126 arcuately spaced from one another and held in a circular pattern by header plates such as header plate 130. The tubes 126 have sector shaped cross sections, as in the first embodiment, so that adjacent sides thereof are parallel to one another for reception of constant-dimentioned air centers 128 generally like the air centers of *6a* and *6b*. The tanks 122, 124 can be made of a suitable plastic material which are secured to the header plate by opposing tabs 134, 136 shown in FIGS. 8 and 9. These tabs are bent over onto the upper edge of radially inner and outer annular retaining shoulders 140, 142 such as formed on the plastic tank 122 as shown in FIG. 8. The tank 122 is formed with integral cylindrical spouts 146, 148 for connection to the hoses 52, 56 leading to and from the water jacket of the internal combustion engine 22. The radially inner and outer annular o-ring type elastomer seals 150, 152 between the header plate and base of the tank such as shown in FIGS. 8 and 9 insures that the fluid in the tanks does not leak to the exterior of the unit. The fluid is forced through the inner core of the heat exchanger in a serpentine manner as described in connection with the first embodiment.

In addition to the inner core, the heat exchanger 120 has an outer core 160 having two separate and discrete circular sections 162 and 164 forming the condenser of an air conditioner and a transmission oil cooler respectively as shown best in FIG. 10. The outer core also has elongated tubes 168 that may be like the tube shown in FIG. *9a* or may be generally sector shaped in cross section, which extend in a circular pattern through the header plate 130 as best shown in FIGS. 7 and 8. The tubes 168 have a centralized flow divider rib 170 down the center thereof so there are two separate flow passages 171 and 171' in each tube. Fluid flowing down the outer radial passage of each tube turns the lower end of the divider and flows up the radial inner passage. The outlet ends 172 (FIG. *9a*) of each passage of each tube 168 is joined to the inlet end 174 end of the next adjacent tube 168 by crossover elbows 176 such as shown in FIGS. 7, 8, 9 and *9a* to provide for the serpentine flow of the vapor and liquid of the condenser section of the air conditioner unit of the vehicle. The passages 171 and 171' could be hydraulically connected by elbows or the ends of the tubes, sealed so that the fluid flows around a foreshortened divider rib 170. As shown best in FIG. 10, there is an inlet passage 180 which is connected to the air conditioner compressor not shown and an outlet 182 that is connected into the evaporator of the air conditioner system.

In addition to the condenser section 162 of the air conditioner unit, the smaller circular section 186 of the outer portion of this heat exchanger is employed for cooling of transmission oil. Accordingly, as shown in FIG. 10, there is an inlet 188 receiving heated oil from the transmission which flows into the core of the heat exchanger 162 in a serpentine manner for cooling as described in connection with the previous embodiments and flows through the lower section 186 into an outlet 190 where it is connected by tubing for flow back to the transmission. Importantly in this invention, the concentric arrangement of tubes 126 and 168 respectively for the radiator and for the discrete air conditioner condenser and transmission cooler are sector shaped in cross section so that standardized air centers can be employed between the adjacent and generally parallel and flat sides of these tubes. In this embodiment, air centers of equal and constant widths which extend from the inner diameter of the inner cylindrical section of the radiator to the outer diameter of the outer cylindrical section of the heat exchanger can be employed. If desired, each section can employ separate air centers.

The invention has been shown in connection with a passenger type automotive vehicle, but it is readily apparent and intended to be employed in other applications, such as off highway working vehicles in which high capacity heat transfer is required or in fixed installations such as commercial air conditioners.

While a preferred embodiment has been shown and described to illustrate the principles of this invention, other modifications will be readily apparent to those skilled in the art. Accordingly, the scope of the invention is set forth in the following claims.

I claim:

1. A heat exchanger having laterally spaced first and second tank portions for receiving heat transferring fluid from a supply of fluid heated by a source of heat energy and after an exchange of heat energy for returning said fluid to said source, a plurality of elongated fluid conducting tubes operatively interconnecting said tank portions to one another, each of said tubes having opposing side walls which diverge from a common inner edge of a minimized width to a common wall to substantially define in cross section the sector of a circle support means provided by an end wall of each of said tank portions for connecting said fluid conducting tubes in a curved pattern adjacent to one another, fluid diverting means in said tank portions so that fluid circulates through said heat exchanger in a serpentined pattern, said side walls of said tubes which facing said side walls of adjacent tubes being disposed at substantially equal distances from each other, a plurality of air center means comprising convoluted heat transfer means defined by a continuous pattern of ridge and groove portions of a substantially constant height operatively interposed between said facing side walls, said ridge portions directly contacting said facing side walls so that said air center means mechanically interconnects and supports said tubes to increase the burst strength thereof and for effectively increasing the external heat radiating surface area of said tubes for augmenting the heat transfer efficiency of said heat exchanger.

2. The heat exchanger of claim 1 wherein said inner edge of each of said tubes is curved and the opposite ends of each of said tubes extend directly into the tank portions.

3. A heat exchanger for transferring heat energy between the flow of air around the exchanger and a pressurized fluid circulated therein comprising tank means and tube passage means for circulating said pressurized fluid, said tube passage means comprising a plurality fluid conducting tubes, each of said tube means being of sector shaped cross section having sides converging to a connection with one another along a longitudinally extending inner edge of minimum width said tank means having support means separate from said tube means for operatively spacing and securing said tube means in a side by side and curved pattern adjacent one another such that the sides of adjacent tube means are substantially equally spaced from one another, air center means disposed between adjacent sides of adjacent tube means, said air center means having convolutions of an overall fixed and constant height substantially equal to one another and operatively disposed between said sides of adjacent tube means so that the convolutions have spaced line contact with adjacent sides of said tube means along the major portions of the lengths thereof for augmenting the transfer of heat energy between the air flowing through said air center means and the pressure fluid contained and circulating through said tube means.

4. The heat exchanger of claim 3 wherein said inner edge of said tube means is curved to present a smooth exterior end surface.

5. The heat exchanger of claim 3 wherein said convolutions of said air center means extend from one side of one tube means to an adjacent side of an adjacent tube means substantially throughout the entire width and length thereof and further comprising attaching means for securing said air center convolutions to the adjacent side portions of said tube means.

6. The heat exchanger of claim 3 wherein at least some of said air center means have a centralized plate sandwiched between a pair of corrugated thin walled heat transfer fins to form an air center assembly, each said fins of said air center assembly having corrugated contact portions for contacting adjacent side walls of said tube means substantially throughout their length and width for augmenting the transfer of heat energy between air flowing through said air center means and said pressurized fluid flowing within said tube means.

7. A heat exchanger for transferring heat energy between air flowing past said heat exchanger and pressurized fluid contained and circulated within said heat exchanger, passage means for said contained fluid comprising a plurality of tubes entirely separate from one another through which said pressurized fluid is circulated, tank means directly supporting and spacing said tubes from one another in a curved pattern, each of said tubes having an outer wall and having side walls which connect to said outer wall and converge and intersect with one another at an inner edge to form a sector shaped cross section and provide an inner edge of minimized width so as to be operative to allow air to readily flow past said tubes while providing a passage for the substantially unrestricted flow of said fluid therethrough, air center means disposed between the outer walls of each of said tubes and the other walls of a adjacent tubes substantially equally spaced thereform and providing support for the side walls thereof to increase the burst strength thereof, said air center means having convolutions of an overall equal height and width to contact the adjacent side portions of said tubes substantially throughout their lengths and widths to augment the heat transfer efficiency of said heat exchanger.

8. A curved heat exchanger for transferring heat energy between ambient air surrounding said heat exchanger and flowing from the interior to the exterior thereof and pressurized heat exchanger fluid being circulated within said heat exchanger, tank means containing said pressurized fluid, a plurality of discrete tube means entirely separate from one another, each said tube means having a sector shaped cross section with a wide exterior wall and opposing side walls which converge from said exterior wall to an inner edge defining an apex of a minimum width, said tube means having end portions received and directly supported by said tank means in a side-by-side annular pattern with side walls of adjacent tube means being substantially equally spaced from one another, air center means disposed between adjacent side walls of said tube means providing annular support of the sides of said tube means to increase the burst strength of said heat exchanger and to increase the heat transfer efficiency thereof, said air center means having a substantially fixed and constant height and width throughout a major portion of their lengths.

9. A heat exchanger for transferring heat energy between a contained fluid medium flowing through the heat exchanger and a fluid medium flowing past said contained fluid medium of the heat exchanger comprising an inner core means having a plurality of arcuately disposed tubes adjacent to one another for circulating said contained fluid medium, tank means for operatively interconnecting said tubes, each of said tubes having a cross section of the general shape of the sector of a circle, each of said tubes having an outer wall and having a pair of side walls which extend inwardly from said outer wall and intersect with one another at their inner ends and form an elongated rounded inner edge, said side walls being substantially parallel with the side walls of adjacent tubes, and air center means which have a substantially constant height and width sufficient to contact adjacent sides of said tubes at spaced lines of contact along the width of adjacent sides of said tubes.

10. A heat exchanger having a tank means for receiving heat transferring fluid delivered thereto from a supply of fluid heated by a source of heat energy and for returning said fluid back to be reheated by said source, a plurality of elongated fluid conducting tubes operatively connected to said tank means spaced at equal distances from one another, each of said tubes having a back wall and having opposing side walls which extend inwardly from said back wall into convergence with one another at an inner edge to generally define in cross section the sector of a circle, said inner edge being rounded along the length thereof, support means for connecting said fluid conducting tubes in a cylindrical pattern adjacent to one another, said side walls of tubes facing said side walls of adjacent tubes being disposed at predetermined substantially equal distance from each other, a plurality of air center means comprising convoluted heat transfer means defined by a pattern of ridge and groove portions of predetermined substantially constant heights operatively interposed between said interfacing sides, said ridge portions directly contacting said interfacing sides of each of said tubes so that said air center means mechanically interconnects said tubes for supporting said tubes to increase the burst strength thereof and for effectively increasing the external heat radiating surface area of said tubes for optimizing the heat transfer efficiency of said heat exchanger.

* * * * *

UNITED STATES PATENT AND TRADEMARK OFFICE

CERTIFICATE OF CORRECTION

PATENT NO. : 5,078,206

DATED : January 7, 1992

INVENTOR(S) : Edward E. Goetz, Jr.

It is certified that error appears in the above-identified patent and that said Letters Patent is hereby corrected as shown below:

Column 1, line 38, "therefor efficiency" should read --efficiency therefor--

Column 2, line 62, delete "tubing"

Column 2, last line, "charge" should read --change--

Column 7, line 19, after "width" insert comma --,--

Signed and Sealed this

Twenty-first Day of September, 1993

Bruce Lehman

*Attest:*

BRUCE LEHMAN

*Attesting Officer*

*Commissioner of Patents and Trademarks*